US005464723A

United States Patent [19]

Chou

[11] Patent Number: 5,464,723

[45] Date of Patent: Nov. 7, 1995

[54] MASS TRANSFERABLE DONOR RIBBONS FOR USE IN THERMAL DYE TRANSFER IMAGING

[75] Inventor: Hsin-hsin Chou, Woodbury, Minn.

[73] Assignee: Minnesota Mining and Manufacturing Company, St. Paul, Minn.

[21] Appl. No.: 299,251

[22] Filed: Aug. 31, 1994

Related U.S. Application Data

[63] Continuation of Ser. No. 58,440, May 7, 1993, abandoned.

[51] Int. Cl.[6] ..... B41M 5/26

[52] U.S. Cl. ..... 430/200; 430/201; 430/270; 430/271; 503/227; 428/328; 428/195; 428/207; 428/913; 428/914; 156/234

[58] Field of Search ..... 503/227; 430/200, 430/201, 945, 270, 271; 428/195, 206, 207, 913, 914, 328; 156/234

[56] References Cited

U.S. PATENT DOCUMENTS

| | | | |
|---|---|---|---|
| 4,321,087 | 3/1982 | Levine et al. | 75/0.5 A |
| 4,359,491 | 11/1982 | Lai-Chun | 428/206 |
| 4,395,263 | 7/1983 | Davis | 8/471 |
| 4,465,767 | 8/1984 | Oba et al. | 430/945 |
| 4,472,479 | 9/1984 | Hayes et al. | 428/324 |
| 4,503,095 | 3/1985 | Seto et al. | 428/914 |
| 4,627,997 | 12/1986 | Ide | 428/216 |
| 4,923,846 | 5/1990 | Katsukake et al. | 503/227 |
| 4,990,486 | 2/1991 | Kamosaki et al. | 503/227 |
| 5,225,392 | 7/1993 | Chang et al. | 428/195 |
| 5,273,857 | 12/1993 | Neumann et al. | 430/201 |
| 5,296,442 | 3/1994 | Fujimura et al. | 503/227 |
| 5,312,683 | 5/1994 | Chou et al. | 428/195 |
| 5,314,862 | 5/1994 | Hirota et al. | 503/227 |

FOREIGN PATENT DOCUMENTS

| | | |
|---|---|---|
| 4014866A1 | 11/1990 | Germany . |
| 60-184868 | 9/1985 | Japan . |
| 60-255489 | 12/1985 | Japan . |
| 61-44688 | 3/1986 | Japan . |
| 63-84985 | 4/1988 | Japan . |
| 63-122592 | 5/1988 | Japan . |
| 63-290789 | 11/1988 | Japan . |
| 2-25395 | 1/1990 | Japan . |
| 2-95898 | 4/1990 | Japan . |
| 3-114883 | 5/1991 | Japan . |
| 8601291 | 5/1986 | Netherlands . |
| 92-3805 | 5/1992 | Rep. of Korea . |
| WO91/14581 | 10/1991 | WIPO . |

OTHER PUBLICATIONS

WO89/1604 1984.4.17 EPO (Abstract Only) (No Translation).

*Primary Examiner*—Janet C. Baxter
*Assistant Examiner*—Martin J. Angebranndt
*Attorney, Agent, or Firm*—Gary L. Griswold; Walter N. Kirn; Susan Moeller Zerull

[57] ABSTRACT

A thermal mass transfer imaging process comprises the thermal mass transfer of a white or metallic donor layer which is then at least partially over-coated with a thermally transferred dye image.

11 Claims, No Drawings

MASS TRANSFERABLE DONOR RIBBONS FOR USE IN THERMAL DYE TRANSFER IMAGING

This is a continuation of application Ser. No. 08/058,440 filed May 7, 1993, now abandoned.

BACKGROUND OF THE INVENTION

1. Field of the Invention

The present invention relates to both thermal mass transfer processes and thermal dye transfer imaging. In particular the present invention relates to the use of a first thermal mass transfer coating on a substrate to provide a background surface having a desirable appearance and which is receptive to a thermally transferred dye.

2. Background of the Invention

Thermal mass transfer and thermal dye transfer processes are technologies that bear some superficial similarities but which are distinct within the technical art. Both processes use a donor sheet and a receptor sheet. The thermal mass transfer donor sheet normally comprises a carrier layer with at least a thermally transferable colorant (a dye or preferably a pigment) in a heat softenable binder. The thermal dye transfer donor sheet comprises a carrier layer with at least a dye layer on the donor surface. The dye layer may consist of only dye or dye in a binder (the binder not transferring when the dye is thermally transferred). Both transfer sheets are used with the donor surface in intimate contact with a receptor material, and the donor sheet is heated in an imagewise manner (e.g., by thermal printheads, irradiation as by a laser or high intensity radiation transmitted through a mask or stencil) to transfer the image forming material. In the thermal mass transfer system, the donor layer is softened by the imagewise heating (and sometimes a receptor layer on the receptor sheet is contemporaneously softened), and the softened area is transferred to the receptor sheet. In thermal dye transfer, the dye is melted or vaporized to transfer to the receptor sheet and tends to be adsorbed and/or absorbed into the surface of the receptor element. The nature of the mechanism of adherence of the transferred image to the receptor sheet makes the nature of the surface of that receptor sheet important for each of the imaging processes. Surfaces which work well for receiving mass transfer images do not necessarily work well for thermal dye transfer.

It is also desirable in thermal dye transfer imaging to have greater image capability than conventional primary additive and subtractive colors. Thermal mass transfer has allowed for some use of more exotic colors and appearances by including fluorescent pigments and metallic pigments into the thermally transferred binders. There are no readily available metallic colors for use with dye transfer processes.

U.S. Pat. No. 4,472,479 (Hayes et al.) describes a light barrier fluorescent ribbon for impact printing which comprises a carrier layer, and on one surface of the carrier layer a binder layer of wax or polymeric resin and fluorescent dye, and a barrier pigment within that layer or in a separate layer. The barrier pigment is a finely divided pigment of reflective material (metal or metal appearing) which does not shift the wavelength of fluorescent light.

Japanese Published patent application (Kokai) 1-258,990 discloses a non-digital transfer donor sheets coated with heat meltable ink layer regions of 3 primary colors or 4 primary colors plus black and a region containing a fluorescent dye. Overprinting of the respective regions with fluorescent dye is disclosed. The dye image is formed by printing onto one sheet and then transferring the entire image.

Japanese Published patent application (Kokai) 63-281,890 discloses a recording material having a thermo-fusible ink layer containing a fluorescent compound and a thermo-fusible ink layer containing colorant and a thermo-fusible ink layer containing an extender with hiding power.

U.S. Pat. Nos. 4,627,997; 4,866,025; 4,871,714; 4,876,237; and 4,891,352. describe thermal transfer of various fluorescent materials. In preferred embodiments, the fluorescent materials are patch coated on a donor ribbon along with magenta, cyan and yellow ink patches. These patents are directed at colorless fluorescent inks that emit in the visible spectrum upon exposure to ultraviolet radiation.

U.S. Pat. No. 3,647,503 describes a multicolored heat transfer sheet in which colored layers are sequentially coated on a substrate. That patent is directed at multicolored transfer imaging and requires good porosity of the uppermost layer to provide good transfer of dye from lower layers.

WIPO published patent application number 10268 (1989) discloses a thermal transfer ribbon having a transfer coating including a fluorescent coloring material of a reddish-orange hue in a wax material. The transfer coating contains 50–90% wax, including 20–45% hydrocarbon wax, 35–65% paraffin wax, 2–30% carnauba wax and 2–25% acetate copolymer; 5–20% fluorescent pigment, and 5–20% color toning pigment.

The use of reflecting barrier pigments is also described in German Patent 3,042,526.

The present invention overcomes deficiencies of the prior art in providing good quality thermal dye transfer images that are generated by thermal transfer onto thermal mass transfer deposited backgrounds. The clarity and variety of thermal dye transfer images produced by this method is improved by thermal mass transferring an opaque white or metallic pigment layer prior to dye transfer.

BRIEF DESCRIPTION OF THE INVENTION

The present invention describes a thermal transfer element and a process for providing a thermal dye transfer image which comprises the steps of placing a thermal mass transfer donor element having a mass transfer donor layer on one surface in contact with a second surface, transferring at least a portion of said thermal mass transfer donor layer to said second surface by heating of said at least a portion of said thermal mass transfer donor layer, and subsequently thermally transferring dye onto said at least a portion of said thermal mass transferred donor layer, said thermal mass transferred layer comprising a dye receptive thermoplastic binder and a pigment. The layer may actually comprise two layers, the uppermost layer (with respect to the carrier layer) being the pigment containing layer and the second layer (adjacent the carrier) is a releasable thermoplastic layer which comprises a dye receptive binder (and is itself transparent or translucent). The layer containing the dye receptive binder is referred to herein as a Mass-transferable And Dye-receptive layer (e.g., MAD layer). MAD has not been defined yet.

By dye receptive we mean that the binder layer, after being thermally mass transferred to a receptor, possesses all the properties of a good thermal dye receptor coating. It would (a) receive thermally transferred dyes from dye donors using the same thermal printer to yield high optical densities, high gradation, good uniformity images, (b) not cause thermal mass transfer of the dye donor colorant coating during thermal dye transfer and (c) not result in reverse transfer of the binder from the receptor to the dye donors during thermal dye transfer.

The coating thickness is preferably from 1μ to 10μ, more preferably, from 2μ to 8μ and most preferably from 3μ to 6μ. The MAD layer has a softening or melting temperature between 50° C. and 120° C., preferably from 60° C. and 110° C., more preferably from 65° C. and 100° C. and most preferably from 70° C. and 90° C.

Dye receptive is understood in the art. It often can be expressed with a range and quality of properties. It is Usually more olephilic than hydrophilic. It is often described as being accepting of dyes into the bulk of the coating by a migration or transfer of the dye into the bulk when the surface of the receptive layer is heated. It is theorized that the softening of the polymer opens up available space between polymer chains to accept dye. It is desirable that the dye receptivity be inclusive of anthraquinone, azo, sulfone, and other sublimable dyes used in the art of thermal dye transfer be particularly capable of absorption into the bulk of the polymer at 100°–150° C.

The pigment is preferably a white pigment or a metallic pigment, particularly a metallic flake which provides high reflectivity.

DETAILED DESCRIPTION OF THE INVENTION

It is a feature of the invention to provide high quality thermal dye transfer images by first using a thermal mass transfer process of a light scattering/light blocking opaque white or metallic background layer for the thermal dye transfer image, especially when the image is placed on top of an undesirably colored background or poorly dye receptive background. The thermal transfer donor ribbons of the invention are suitable for imaging applications in desktop publishing, direct digital non-critical color proofing, and short-run sign manufacture, for example.

In one aspect the invention discloses a thermal mass transfer donor ribbon comprising a substrate coated on at least a portion thereof with a MAD layer and another portion or the same portion is coated thereon with an opaque white or metallic background ink layer.

In another aspect the invention discloses a white or metal thermal mass transfer donor ribbon comprising interspersed patches of a MAD transfer layer and an opaque white or metallic thermal mass transfer background ink layer.

In yet another aspect the invention discloses a process for transfer imaging wherein two layers of material, an opaque white or metallic background mass transfer layer and a MAD layer, are thermally transferred in successive steps to a receptor film, wherein the resulting thermally transferred MAD image is exposed (that is, it is on the exterior surface of the thermal transfer image on the receptor).

In a further aspect the invention discloses a process for transfer imaging comprising the steps of thermally mass transferring an opaque white or metallic (with a MAD) background layer from a donor ribbon to a receptor sheet (e.g., of film or paper) thereby creating a white or metallic background image, and then thermally transferring dyes from a 4 patch dye donor layers from said donor ribbon or another donor element onto said white or metallic background image.

Two thermal transfer donor ribbon constructions are useful in the practice of the present invention. In the first donor embodiment, a thermally mass transferable layer containing white pigment or a metallic particle (or flake) is coated onto a substrate. Another thermally transferable MAD layer is coated adjacent to the first thermally transferable layer on the same ribbon or sheet, or in a second embodiment is available on a separate donor element.

The flakes used in the practice of the present invention are distinct from the metal particles which are believed to have been heretofore used in many transfer imaging systems. Rather than being of relatively uniform dimensions, the flakes necessary for use in the materials of the present invention have comparatively high (as compared to conventional particles) ratios of length to thickness. The ratio of length (whether average length, mean length, or other forms of defining a major dimension of a particulate) to thickness in particles normally may range from 1:1 to 10:1 or the like and be considered a normal distribution of particle. Flakes in the practice of the present invention have a minimum average ratio of length to thickness of at least 20:1 or at least 25:1, preferably 100:1, and more preferably 500:1 to obtain the benefits of the present invention. Ranges of 25:1 to 2000:1 are also acceptable, or 40:1 or 50:1 to 500:1 are preferred. They should likewise have a maximum average ratio of length to thickness of 2000:1 and more preferably 1000:1. By average ratio it is meant the number average of the ratios of the individual particles. The thickness of the flake is between 100Å to 1500Å, preferably between 200Å to 1000Å, more preferably between 250Å to 750Å and most preferably between 300Å to 500Å.

According to one embodiment of the present invention, the opaque white or metallic thermal mass transfer donor ribbons of the present invention comprise a substrate having coated on at least a portion thereof an ink layer, wherein said white pigment or metallic containing ink layer comprises a thermoplastic dye receptive binder. The term "dye receptive binder" is well understood in the art and indicates that the binder is capable of receiving good image densities from a thermally transferred dye. Although the mechanism for achieving this is not well understood, there is a belief that the polymer 'loosens' upon heating, opening up space between polymer chains. The dye is believed to move into these spaces through diffusion or sublimation so as to be retained in the receptive polymer. The materials are ordinarily oleophilic (hydrophobic) polymeric resins having a thermal softening point between 35 and 120 degrees Celsius.

In the pigment containing layer, it is desirable to have white opaque pigments in a thermoplastic binder. This binder may itself be dye receptive or it will need the separate dye receptive binder layer between the pigment layer and the carrier. The separate dye receptive binder layer releases from the carrier during mass transfer imaging and becomes the outermost layer on the imagewise transferred mass transfer image. The white pigment is preferably titania, alumina, chromia a metal carbonate, or the like of white color. The metal particles may be of any metal, but it is desirable that a true metallic (reflective and shiny) appearance be provided. This can be best accomplished by using metal flakes, rather than approximately spherical particles as the metal or direct vapor metal coating. The coating composition for the metallic pigment containing layer can be readily produced according to the teachings of U.S. Pat. No. 4,321,087 which describes a method for producing suspensions or dispersions of metal flakes. The metal flakes are lifted from a substrate into a solvent solution which may contain a binder (e.g., nitrocellulose). By selecting the appropriate binder dissolved or dispersed in the solvent, the appropriate dye receptive polymer may be combined with the metal flakes.

The loading of polymer and metal (or pigment) may be readily controlled by one of ordinary skill in the art. In this way, a high pigment to binder ratio is obtained improving the light scattering or reflecting ability of the opaque white or metallic background layer and permitting the use of thin opaque white or metallic background ink layers.

Preferably, the pigment containing layers are prepared by dispersing pigment in a binder and coating the dispersion onto a carrier layer. Opaque white background ink layers comprise a white pigment in a binder. The binder for either of the two embodiments of thermally mass transferable MAD layers comprises at least one of a wax-like substance and a polymeric resin.

Suitable white pigments include, but are not limited to, white metal oxides such as titanium dioxide, zinc oxide, aluminum oxide and hydroxide, magnesium oxide, etc.; white metal sulfates such as barium sulfate, zinc sulfate, calcium sulfate, etc., and white metal carbonates such as calcium carbonate, etc. For optimal stability and operability of the present invention and the images formed thereby the white pigments should have very low solubility in water. The white pigments may be optionally treated with surface modifying agents to improve their dispersibility in the binder.

Suitable wax-like substances have a melting point or softening point of from about 35° to 140° C., and include but are not limited to higher fatty acid ethanolamines such as stearic acid monoethanolamide, lauric acid monoethanolamide, coconut oil monoethanolamide; higher fatty acid esters such as sorbitan behenic acid ester; glycerine higher fatty acid esters such as glycerine monostearic acid ester; acylated sorbitols such as acetylsorbitol and benzoylsorbitol, acylated mannitols such as acetylmannitol; and waxes such as beeswax, paraffin wax, carnauba wax, crystalline waxes, synthetic candelilla waxes, Chlorez™ waxes, etc.; and mixtures thereof. Preferred wax-like materials include stearic acid monoethanolamide (mp 91°–95° C.), lauric acid monoethanolamide (mp 80°–84° C.), coconut oil fatty acid monoethanolamide (mp 67°–71° C.), sorbitan behenic acid ester (mp 68.5° C.), sorbitan stearic acid ester (mp 51° C.), glycerine monostearic acid ester (mp 63°–68° C.), acetyl sorbitol (mp 99.5° C.), benzoyl sorbitol (mp 129° C.), and acetyl mannitol (mp 119°–120° C.).

Suitable polymeric resins have melting or softening points in the range of about 20° to 180° C., preferably in the range of 40° to 140° C., more preferably in the range of 55° to 120° C., and most preferably in the range of 60° to 100° C. and include, but are not limited to, polycaprolactone, polyethylene glycols, aromatic sulfonamide resins, acrylic resins, polyamide resins, polyvinyl chloride and chlorinated polyvinyl chloride resins, vinyl chloride-vinyl acetate copolymers, alkyd resins, urea resins, melamine resins, polyolefins, benzoguanamine resins and copolycondensates or copolymers of the above resin materials. Preferred polymeric resins are polycaprolactones having an average molecular weight of 10,000 g/mol (mp 60°–65° C.), polyethylene glycols having an average molecular weight of 6000 g/mol (mp~62° C.), low condensation polymerized melamine toluene-sulfonamide resins (sp~105° C.), low condensation polymerized benzyltoluene sulfonamide resins (sp~68° C.), acrylic resins (sp~85° C.), and linear polyamide resins (sp~60° C.). The terms "mp" and "sp" refer to "melting point" and "softening point," respectively.

Preferably, thermal mass transfer layers and opaque white or metallic background ink layer have a melting point (mp) or softening point (sp) of 50°–140° C. to enhance the thermal transferring property.

Suitable substrate materials for the thermal mass transfer donor element may be any flexible material to which a MAD or opaque white/metallic pigment ink layer may be adhered. Suitable substrates may be smooth or rough, transparent, opaque, and continuous or sheet-like. They may be essentially non-porous. Preferred backings are white-filled or transparent polyethylene terephthalate or opaque paper. Non-limiting examples of materials that are suitable for use as a substrate include polyesters, especially polyethylene terephthalate, polyethylene naphthalate, polysulfones, polystyrenes, polycarbonates, polyimides, polyamides, cellulose esters, such as cellulose acetate and cellulose butyrate, polyvinyl chlorides and derivatives, etc. The substrate generally has a thickness of 1 to 500 μm, preferably 2 to 100 μm, more preferably 3 to 10 μm.

By "non-porous" in the description of the invention it is meant that ink, paints and other liquid coloring media will not readily flow through the substrate (e.g., less than 0.05 ml per second at 7 torr applied vacuum, preferably less than 0.02 ml per second at 7 torr applied vacuum). The lack of significant porosity prevents absorption of the heated receptor layer into the substrate.

In another embodiment of the present invention thermal mass transfer ribbons are prepared by coating a white or metallic containing background ink layer and the dye receptive thermal transfer layer onto one side of a suitable substrate in a pattern such that the two ink layers are interspersed in a manner so that the area of the substrate covered by each ink layer is approximately equal. An area of (dye receptive MAD) material may also appear on the same ribbon or sheet. In this case it would be preferred to have the background layer and the dye receptive layer the same or overlie each other. The background and the dye image may be identical (coextensive in all direction), substantially overlap, completely overlap, outline one another, or border each other.

The thermal transfer ribbons of the present invention are generally employed in combination with a receptor sheet in a process for transfer imaging wherein at least two layers of material, an opaque white or metallic background ink layer (with or without an adjacent dye receptive layer) and a MAD layer, are transferred in sequential steps. The MAD layers when transferred, as previously discussed, may or may not be a distinct and separate layer from the color content layer, but it is transferred separately from any background image layer.

The thermal transfer donor ribbons of the invention are suitable for image production in desktop publishing, direct digital non-critical color proofing, short run sign manufacture, and so forth, especially for graphics desiring unusual color generation.

Coating of the thermally mass transferable layers on the donor sheets may be accomplished by many standard web coating techniques such as imprint gravure, single or double slot extrusion coating, and the like. Imprint gravure is particularly useful for patch-type coatings in which there are interspersed regions of opaque white or metal colorants on a ribbon or sheet. Layer coating thicknesses useful in the present invention are 0.1 to 50 μm, preferably 0.5 to 10 μm, most preferably 1 to 6 μm.

The donor ribbons of the present invention are generally used in thermal printing by contacting the transferable layer of the donor ribbon with a receptor sheet or film such that at least one thermally transferable donor layer is in contact with the receptor sheet. Heat is applied, either from a thermal stylus or an infrared heat source such as an infrared laser or a heat lamp and the donor layer is transferred to the receptor. The heat may be applied to the back of either the donor ribbon or receptor sheet or may be directly introduced to a transferable donor layer.

Preferred receptor sheet materials are Dai Nippon Type I and Type V receptor films (Dai Nippon Insatsu K.K., Tokyo, Japan), Dupont 4-Cast™ receptor film (E. I. Dupont de Nemours Co., Wilmington, Del.), Scotchcal film (3M Co., St. Paul, Minn.), 3M Rainbow™ transparency, 3M Rainbow™ ABR receptor and polyethylene terephthalate. The receptor sheets may be colored, that is they may have an optical density of at least 0.2 in the visible region of the electromagnetic spectrum.

In a preferred embodiment a release coating is applied to the back side of the donor ribbon (i.e., the side opposite the thermally transferable donor layer(s)) to improve handling characteristics of the ribbon and reduce friction. Suitable release materials include, but are not limited to, silicone materials including poly(lower alkyl)siloxanes such as polydimethylsiloxane and silicone-urea copolymers, and perfluorinated compounds such as perfluoropolyethers.

The following examples further illustrate practice of the present invention and should not be considered limiting.

The following experiments serve only to demonstrate the feasibility of the whole concept.

I. EXPERIMENTAL EXAMPLES FOR DYE RECEPTIVE WHITE PRINTING

Basic solutions/emulsions/dispersions;

A. Base White a: A stable dispersion of $TiO_2/Al(OH)_3$/Acryloid C-10LV, 5/3/2, 30% solid in toluene was mixed through ball milling for overnight.

B. Base White b: A stable dispersion of $TiO_2/Al(OH)_3$/Carboset XL-11, 5/3/2, 30% solid in ETOH was mixed through ball milling for overnight.

C. Wax Emulsion: A 5% solid wax-polymer emulsion in Toluene was prepared as following. First, a clear, 5% solid solution of the wax-polymer with the ingredients; Chlorowax 70/Shellwax 700/Acryloid B82/Carnauba wax/Synthetic Candelilla/Staybelite Ester 10/Elvax 210, 1.25/1.67/0.1/2.5/1.0/0.05/0.6, was prepared at an elevated temperature of ~70° C. Then a small amount (2–5% to the solid content of the solution) of charging agent, Zirconium Hex-Cem was added to the solution. The solution was then brought back to room temperature (preferably under high speed agitation) and a stable emulsion was obtained.

D. Hydrophobic $SiO_2$ dispersion: Hydrophobic $SiO_2$ TS610 (Cabot) was dispersed in Acryloid B99 at 1/1 ratio and a solid content of 10% in Toluene and either sonicated or ball milled until a clear dispersion was obtained.

E. Acrylic Solution: Elvacite 2044 was dissolved in Toulene to make a 10% solid clear solution.

1. Single Layer, One Pass White Layer

A coating dispersion was prepared by mixing 2 parts of A and 5 parts of C. The resultant dispersion has solid content of ~12%. A #12 Meyer was used to coat the dispersion on a 6μ PET substrate. After air dry, the coated substrate was then oven dried at 80° C. for 1 minute to result in the final exotic white donor.

a). Demonstration of the concept using an experimental Model II 200 dpi thermal printer.

Thermal mass transfer of the exotic white to 3M Rainbow dye receptor was carried out at 20 volts (~3.8 J/cm$^2$). Good complete transfer has been obtained both in the solid and the alphanumerical areas. The resolution was >200 dpi, limited by the printer resolution. A piece of Dainippon magenta dye donor was used to thermal dye transfer on top of the white image at 20 volts. On the solid white area, a uniform and high density magenta image with good resolution of >200 dpi was obtained. The ROD was measured to be ~0.8.

b). Demonstration of the concept using a higher energy output Model III 200 dpi thermal dye printer.

In this experiment, a monochrome 3M image was chosen for mass transferring the dye receptive white layer and a tri-color image, Pinky, was used for thermal dye transfer. The same receptor used in 1a) was used. The white image was transferred at 10.75V (~9.4 J/cm$^2$) and the YMC were transferred at 9.5V(~7.4 J/cm$^2$). Beautiful continuous toned color dye image was obtained on both the white image area as well as the clear dye receptor areas.

2. Double Layer, One Pass Transparent and White a). Demonstration of the concept using Model II thermal printer.

A coating dispersion was prepared by mixing 1 part of D and 4 parts of C. The resultant dispersion has solid content of 6%. A #24 Meyer rod was used to coat the dispersion on a 6 micrometers PET substrate. After air drying, the coated substrate was then overcoated with B (the opaque white base b) with a #5 Meyer bar. After air dry again, the bi-layer construction was oven dried at 80° C. for 1 minute to result in the final exotic white donor.

Thermal mass transfer of the exotic white to a 3M Rainbow dye receptor was carried out at 20 volts (~3.8 J/cm$^2$). Good complete transfer was obtained both in the solid and the alphanumerical areas. The resolution was ~200 dpi because of the relative thick coating (~4.5 micrometers). A piece of Dainippon magenta dye donor was used to thermal dye transfer on top of the white image at 20 volts. On the solid white area, a uniform and high density magenta image with good resolution of >200 dpi was obtained. The ROD was measured to be ~1.13.

b). Demonstration of the concept using the Rainbow thermal printer.

An exotic double layer white donor similar to that used in example 2a) was prepared. It was thermally mass transferred to a 3M Rainbow™ Transparency using the thermal printer II at 20 volts (~3.8 J/cm$^2$) on a 8½×11 dye receptor. The dye receptor was then fed into a 3M Rainbow™ thermal printer (model 2710AFN). Local self-print mode was activated to print the test patterns for image evaluation. Continuous tone dye receptivity of our dye layer was again demonstrated. No mass transfer of any dye donor layers was observed. The ROD of the darkest black patch is 1.33. In comparison, the same patch transferred on the receptor without the white underlayer provided a ROD of 1.21.

3. Two patch, Two Passes Transparent and White a). Demonstration of the concept using Model II thermal printer.

Dispersion A (opaque white base a) and a clear dye receptive emulsion/dispersion made of 1 part of E, 2.5 parts of D and 10 parts of C were used for this experiment. However, they were coated separately on two sheet of 6 micrometer PET and then spliced together to simulate a two-patch coated exotic white donor ribbon. The white patch was coated from a 30% solid dispersion with a #8 Meyer bar whereas the clear patch was from a 6% solid dispersion with a #30 Meyer bar. Both layers are thicker than those individually in example 2.

Both patches were thermally mass transferred successively such that the clear layer is image-wise on top of the white layer to a 3M Rainbow dye receptor at 20 volts (~3.8 J/cm$^2$). Good complete transfer was obtained both in the solid and the alphanumerical areas. The resolution was >200 dpi. Dainippon magenta and black dye donors were then used to thermal dye transfer on top of the white image at 20 volts. On the solid white area, uniform and high density magenta or black images with good resolution of >200 dpi were obtained. The ROD was measured to be ~0.92 for magenta and 1.25 for black. This is to be compared with a ROD of only 0.8 (Magenta) and 1.04 (Black) for the dye transfers on the single layer white of Example 1a.

b). Demonstration of the concept using the Rainbow thermal printer.

Both patches were thermally mass transferred successively such that the clear layer is image-wise on top of the white layer on a 3M Rainbow dye receptor using the thermal printer II at 20 volts (~3.8 J/cm$^2$) on a 8½×11 dye receptor. The dye receptor was then fed into a 3M Rainbow thermal printer (model 2710AFN). Local self-print mode was activated to print the test patterns for image evaluation. Continuous tone dye receptivity of our dye layer was again demonstrated. No mass transfer of any dye donor layers was observed. The ROD of the darkest black patch is 1.25.

II. EXPERIMENTAL EXAMPLES FOR COMPOSITE METALLIC PRINTING

Example 1

1. Thermal mass transferrable metallic Aluminum ribbon.

A 0.4% solid of Dispal 120/Triton X-100, 2.5/1, was continuously extrusion coated on a 4.5 micrometer Toray TR 101 thermal transfer substrate film to generate a 0.064 micrometer dry thickness release coat. The thickness corresponds to an effective 80% bohemite particle coverage on the substrate surface. A 300 Å aluminum film was then subsequently vapor deposited on the release coat to make the thermally mass transferrable "silver" ribbon.

2. Basic solutions/emulsions/dispersions for Metallic MAD.

C1. Wax Emulsion: A 7% solid wax-polymer emulsion in Toluene was prepared as following.

First, a clear, 5% solid solution of the wax-polymer with the ingredients; Chlorowax 70/Shellwax 700/Acryloid B82/Carnauba wax/Synthetic Candelilla/Staybelite Ester 10/Elvax 210, 1.25/1.67/0.1/2.5/1.0/0.05/0.6, was prepared at an elevated temperature of ~70° C. Then a small amount (2–5% to the solid content of the solution) of charging agent, Zirconium Hex-Cem was added to the solution. The solution was then brought back to room temperature (preferably under high speed agitation) and a stable emulsion was obtained.

D1. Hydrophobic $SiO_2$ dispersion: Hydrophobic $SiO_2$ TS610 (Cabot) was dispersed in Acryloid B99 at 1/1 ratio and a solid content of 20% in toluene and either sonicated or ball milled until a clear dispersion was obtained.

F. Acrylic Solution: Elvacite 2014 was dissolved in toluene to make a 25% solid clear solution.

The MAD layer was prepared by mixing 0.6 parts of F, 1 part D1, and 8 parts of C1. The resultant dispersion has solid content of ~10.3%. A #30 Meyer Bar was used to coat the dispersion on a 6 micrometer PET substrate. After air dry, the coated substrate was then oven dried at 80° C. for 1 minute to result in the final MAD layer donor. The dry thickness of the dye receptive layer is ~5 micrometer.

The demonstration of the concept has been carried out using a 200 dpi thermal dye printer.

In this experiment, a monochrome 3M image was chosen from the mass memory for demonstration. A metallic "silver" 3M was first transferred on a 3M Desktop Rainbow Transparency (4.0 Mil) at a transferring voltage of 14 volts. A clear MAD 3M image was then transferred on top of the metallic 3M image in registration at 11.25 volts. This was followed with the appropriate thermal dye transfers to generate the composite metallic color. For instance, a red metallic 3M image was obtained with a subsequent yellow dye transfer at 11.25 volts and a magenta dye transfer at 13 volts, a blue metallic 3M with a subsequent cyan dye transfer at 12.5 volts, a green metallic 3M with a subsequent yellow dye transfer at 11.25 volts and a cyan dye transfer at 12.5 volts, a "gold" metallic 3M with a subsequent yellow dye transfer at 12 volts, and a brown metallic 3M with a subsequent yellow dye transfer at 11.25 volts and a magenta dye transfer at 12.5 volts. In this printer a voltage input of 10 volts corresponds to an energy in the printhead of 6.7 Joules/cm$^2$.

Example 2

Double layer coating; a dye receptive undercoat layer for composite metallic colors.

Two solutions were made for this application. The first solution was a transferrable dye receptive layer consisting of 0.5/1/8 Elvax 210/(1/1 TS610/B99)/Wax Emulsion at 6.4% in toluene. This solution was coated out using a #8 Meyer Bar onto 6μ PET to give an approximate 0.9μ dry coating thickness. This coat was oven dried at approximately 80° C. for one minute. Then a solution of 3% Metasheen Silver MSP 1391 in ethanol was coated onto 6μ PET using a #10 Meyer Bar to give an approximate 0.5μ dry coating thickness. Thus, the total thickness of both of the layers was approximately 1.4μ. This was then printed onto Dai Nippon Type I receptor and 3M Desktop Rainbow Transparency (4.0 mil). Resolution was again good (>200 dpi) between 14 and 18 volts (1.86 J/cm$^2$ to 3.08 J/cm$^2$) with a more complete transfer at these energies. It was then possible to transfer a dye on top of these two layers at a resolution >200 dpi. The ROD of the dye transfer of cyan was 1.05.

MATERIALS AND VENDORS

| Material | Vendor |
|---|---|
| RBH pigments | RBH Dispersions, INC. (Bound Brook, NJ) |
| Metasheen Silver Ink | Alford Packaging (Carlstadt, NJ) |
| TS610 hydrophobic $SiO_2$ | Cabot Co. (Tuscola, IL) |
| Acryloid B82, B99 | Rohm & Haas (Philadelphia, PA) |
| Elvacite 2014, 2044 | E. I. DuPont (Wilmington, DE) |
| $Al(OH)_3$, Alcoa SpaceRite S-11 | ALCOA (Bauxite, AR) |

-continued

| MATERIALS AND VENDORS | |
|---|---|
| Material | Vendor |
| Alumina | |
| Zirconium Hex-cem | Mooney Chemical, Inc. (Cleveland, OH) |
| Elvax 210 | E. I. DuPont (Wilmington, DE) |
| Staybelite Ester 10 and EHEC X-high (ethyl cellulose) | Herculus Inc. (Wilmington, DE) |
| Chlorowax 70 | Diamond Shamrock (Cleveland, OH) |
| Shellwax 700 | Shell Chemical Co. (Houston, TX) |
| Carnauba wax | Frank B. Ross Co. (Jersey City, NJ) |
| Synthetic Candelilla wax | Frank B. Ross Co. (Jersey City, NJ) |
| Carboset XL-11 | B. F. Goodrich (Cleveland, OH) |

Example 3

A dye receptive metallic coating the same as example 2 was prepared on a 4.5 m PET film with antistick backcoat. Before printing, the film patch properly was spliced on a regular YMCK ribbon between the K patch and the Y patch. A proper prompt mark to initiate printing was placed at the beginning of the spliced film patch.

A regular black and white image called "ballons" was imported into Photoshop software program using a Macintosh computer. The image was artificially converted from black and white to CMYK and the channels were split. 4 individual images designated "ballons Y", "ballons M", "ballons C" and "ballons K" that are exactly the same were generated. "ballons M, C, K" were modified using the tools of the Photoshop program in order to make the final printed image color instead of B&W. Those YMCK images were then opened as RAW image files in Photoshop and merged under "Mode" menu into a single composited YMCK file. The image was saved as a CMYK Photoshop image file with a 300 dpi resolution.

After the proper receptor and the spliced donor ribbon were properly placed in the Rainbow printer, the image was opened in the 3M Rainbow Color Proofer software program, RIP processed and printed. With the spliced patch being printed as Y-separation, Y-patch as M-separation, M-patch as C-separation and C-patch as K-separation, a composited metallic colored image was created. The image had a resolution of 300 dpi and appeared to be metallic of various colors.

I claim:

1. A thermal mass transfer donor element comprising a flexible substrate having coated thereon a layer of a clear thermally mass transferable dye receptive binder, which is receptive to thermally transferred dyes, and a thermally mass transferable pigment layer comprising a shiny metal pigment and a second binder, wherein said dye receptive binder layer is adjacent said pigment layer on said substrate or in between said pigment layer and said substrate, wherein said donor element is suitable for thermally transferring metallic images.

2. The thermal mass transfer donor element of claim 1 in which the donor element is in the form of a ribbon or a sheet.

3. The thermal mass transfer donor element of claim 1 wherein the clear dye receptive binder layer comprises particulates and at least one of a wax-like substance and a polymeric resin and has a softening temperature between 50° and 120° C.

4. The thermal mass transfer donor element of claim 3 wherein the particulates are $SiO_2$.

5. The element of claim 1 wherein said dye receptive binder is capable of absorbing at least one sublimable dye selected from the group of anthraquinone, azo, and sulfone dyes.

6. A process for providing a mixed thermal mass transfer and thermal dye transfer image on a receptor surface comprising thermal mass transferring a shiny metal pigment and a dye receptive binder, which is receptive to thermally transferred dyes, onto a receptor surface and thermally transferring a dye on top of at least part of said shiny metal pigment.

7. The process of claim 6 wherein said dye receptive binder is capable of absorbing at least one sublimable dye selected from the group of anthraquinone, azo, and sulfone dyes.

8. The process of claim 6 wherein the shiny metal pigment and the dye receptive binder are in a single layer and are transferred in a single step.

9. The process of claim 6 wherein the shiny metal pigment and the dye receptive binder are in separate layers and are transferred from a single thermal mass transfer donor element.

10. The process of claim 6 wherein the thermal mass transfer step and the thermal dye transfer step are performed in sequence from a single thermal transfer donor element.

11. A thermal mass transfer donor element suitable for thermally transferring metallic images consisting essentially of a substrate having coated thereon a layer of a clear, thermally mass transferable, dye receptive binder, which is receptive to thermally transferred dyes, and a thermally mass transferable pigment layer comprising a shiny metal pigment and a second binder, wherein said dye receptive binder layer is adjacent said pigment layer on said substrate or in between said pigment layer and said substrate.

* * * * *